United States Patent [19]

Lamb

[11] 3,944,106

[45] Mar. 16, 1976

[54] STORAGE TANK

[76] Inventor: Thomas Lamb, 3705 Riverwood Road, Alexandria, Va. 22309

[22] Filed: June 20, 1974

[21] Appl. No.: 481,302

[52] U.S. Cl. ..... 220/5 A; 114/74 A; 220/9 LG; 220/15; 220/71

[51] Int. Cl.[2] .. B63B 25/08; B65D 5/02; B65D 7/42

[58] Field of Search ..... 220/3, 9 A, 5 A, 15, 18, 220/83, 71, 9 LG; 114/74 A; 52/245, 2

[56] References Cited

UNITED STATES PATENTS

| | | | |
|---|---|---|---|
| 2,341,044 | 2/1944 | Jackson et al. | 114/74 A |
| 2,673,001 | 3/1954 | Ulm et al. | 220/18 |
| 2,683,550 | 7/1954 | Mumment | 220/18 |
| 2,909,039 | 10/1959 | Richardson | 114/74 A |
| 3,109,294 | 11/1963 | Messer | 114/74 A |
| 3,314,567 | 4/1967 | Becken | 220/5 A |
| 3,339,515 | 9/1967 | Reed | 220/9 LG |
| 3,425,583 | 2/1969 | Bridges | 114/74 A |
| 3,428,205 | 2/1969 | Basile et al. | 114/74 A |
| 3,495,732 | 2/1970 | Clarke et al. | 114/74 A |
| 3,528,582 | 9/1970 | Rigollot | 220/83 |
| 3,595,430 | 7/1971 | Massac | 220/9 LG |

FOREIGN PATENTS OR APPLICATIONS

| | | | |
|---|---|---|---|
| 291,061 | 5/1928 | United Kingdom | 220/3 |

*Primary Examiner*—William Price
*Assistant Examiner*—Allan N. Shoap
*Attorney, Agent, or Firm*—Stewart and Kolasch

[57] ABSTRACT

A storage tank having a unique geometric shape and adapted to contain a liquid or a compressed gas at pressures above atmospheric pressure. The tank can be made of special materials for low temperature applications. The weight of the tank and its contents is carried on an integral supporting structure advantageously located at the lower corners of the tank. Since the tank is a single walled, pressure-type vessel, it can be utilized in the transportation of liquid natural gas without the need for a secondary liquid-tight barrier.

16 Claims, 20 Drawing Figures

FIGURE 2
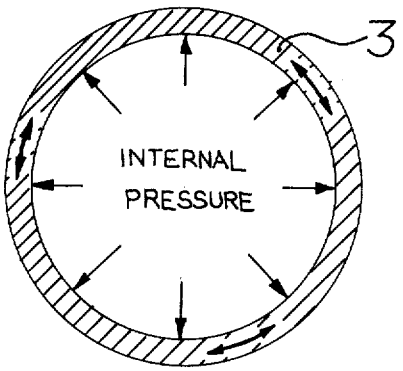
FIGURE 3
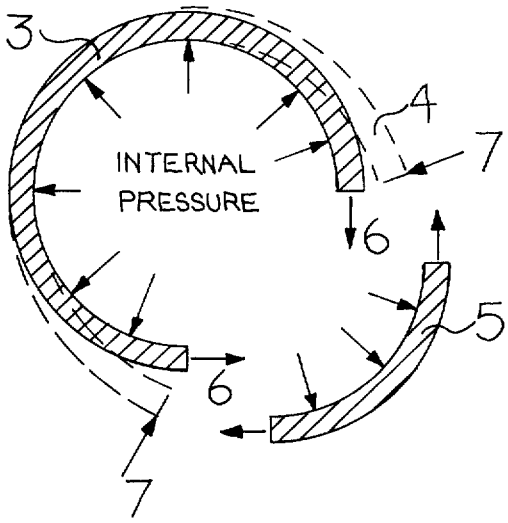
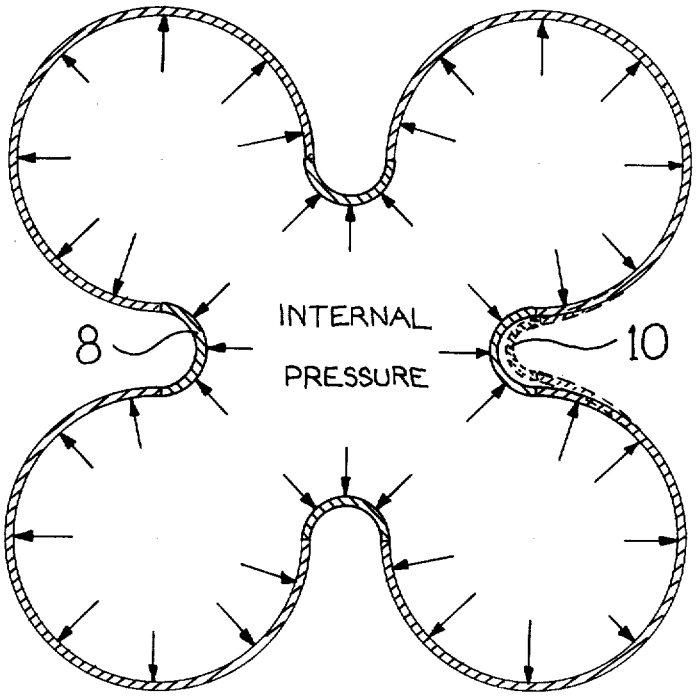
FIGURE 4

FIGURE 5
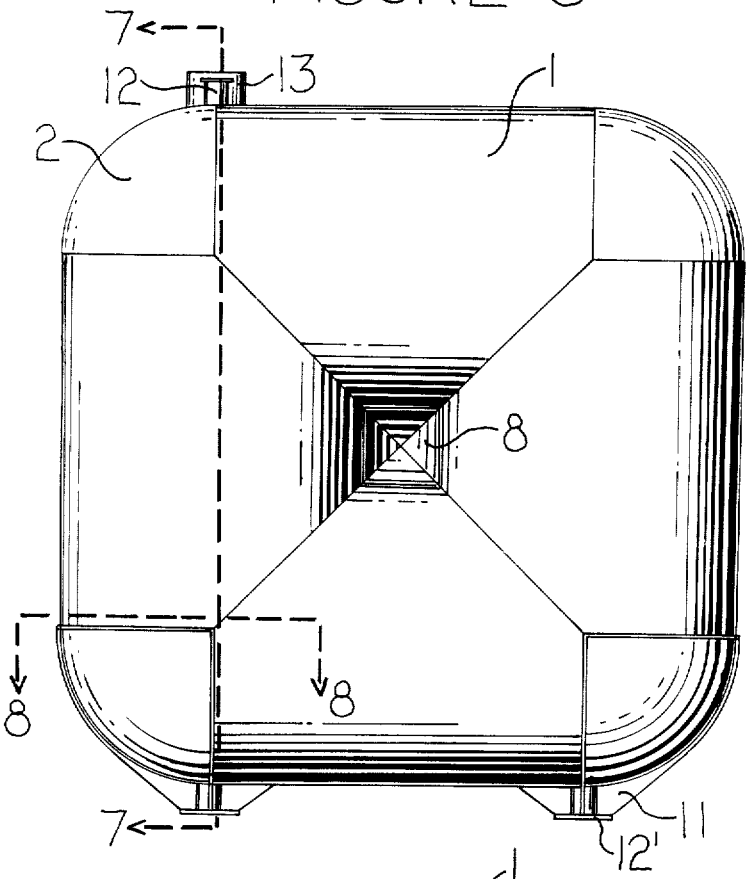
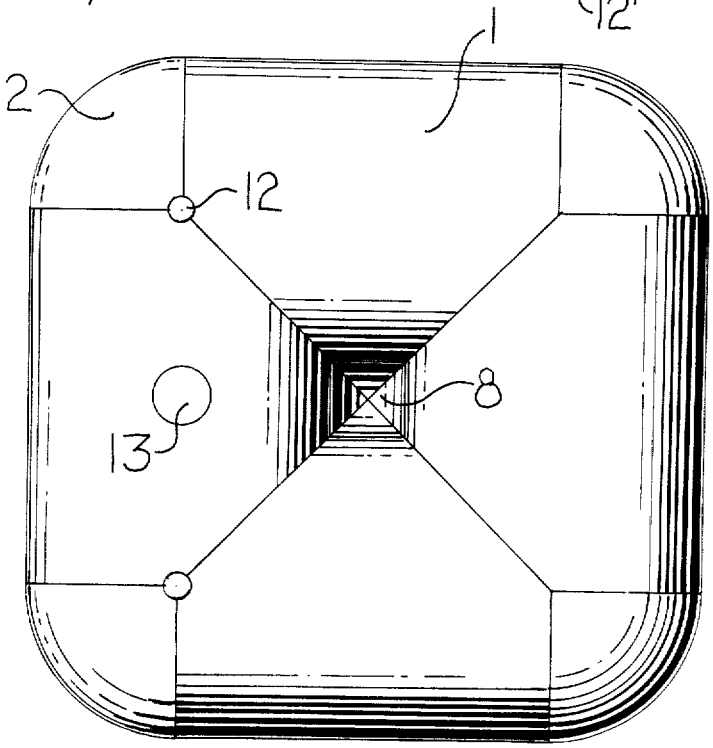
FIGURE 6

FIGURE 8
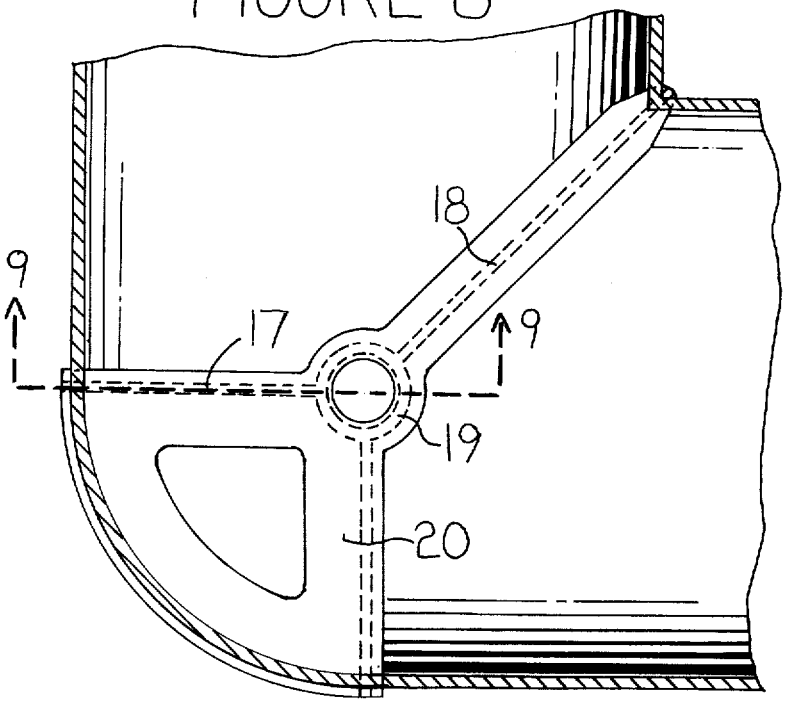
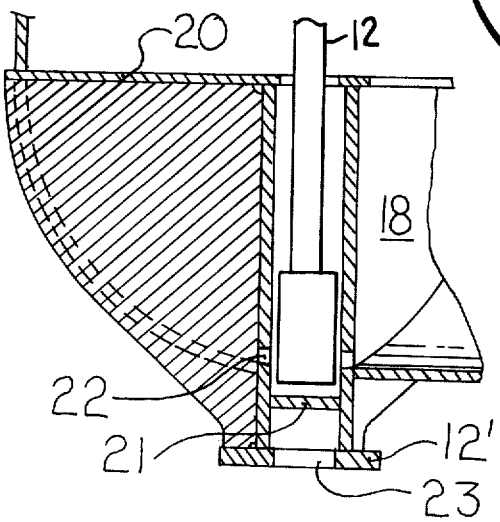
FIGURE 9
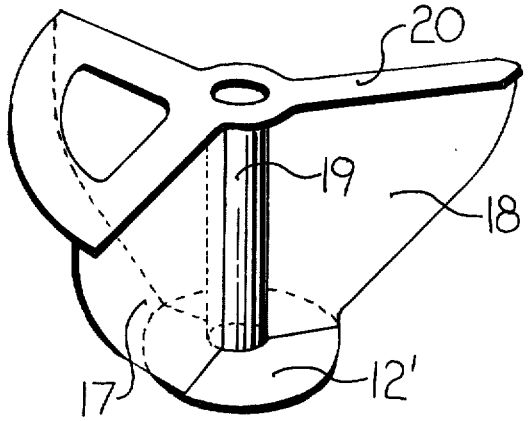
FIGURE 9A

FIGURE 15
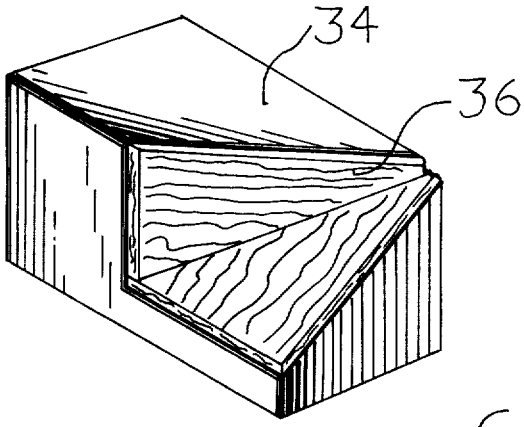
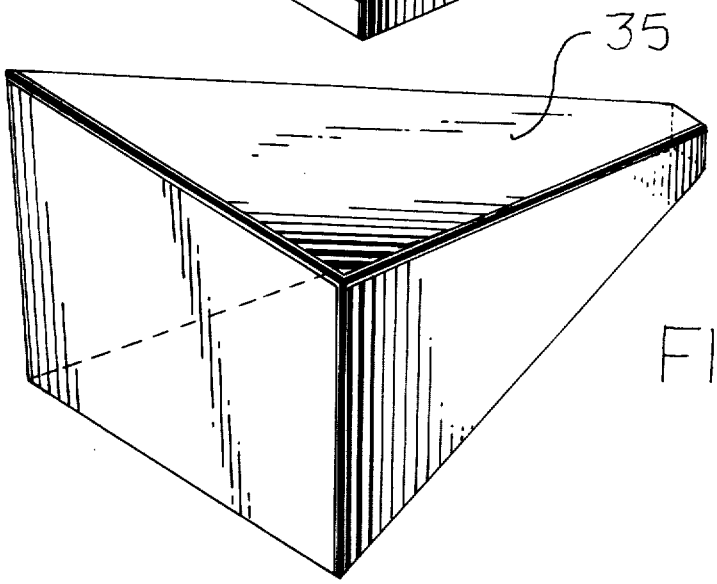
FIGURE 16
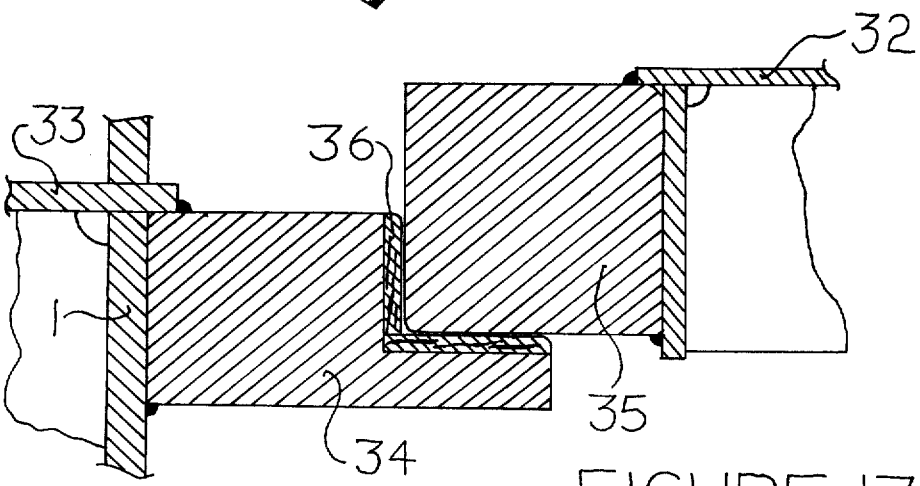
FIGURE 17

STORAGE TANK

BACKGROUND AND SUMMARY OF THE INVENTION

The present invention relates to a tank adapted to contain liquid and/or compressed gases during storage or transportation and more particularly, to a storage tank which is effective in transporting liquid natural gas in a floating vessel as well as the apparatus required for supporting the tank within the hull of the vessel.

The volume that a gas occupies at normal ambient temperatures is many hundredths of time the volume that it occupies as a liquid. For this reason, many useful gases are stored in their liquid form. Gases can be liquified by either compressing them until their critical pressure is reached or by cooling them until their critical temperature is reached. It has been proven more practical to refrigerate natural gas to its liquid form rather than to compress it. In any event, some petroleum gases are stored and/or transported in a semi-compressed state.

The various forms of containment tanks which are presently being used include those having a spherical, cylindrical or prismatic shape. A recent application of liquid storage tanks is in the marine transportation of liquid natural gas (LNG). However, the storage and marine transportation of liquid natural gas at substantially atmospheric pressure and at very low temperatures, for example, about −260° F., presents many problems. These problems are especially difficult to solve in marine transportation and include, for example, structural stresses due to static and dynamic loading, deflection of the hull, deflection of the tanks, and support requirements adapted to accept temperature contraction and temperature stresses in the hull of the vessel and the tanks. These problems have been overcome in a number of ways including the use of suspended spherical tanks, double walled semi and full membrane tanks and prismatic tanks which are supported by the surrounding insulation which in turn is supported by the hull structure of the vessel. Even though liquid petroleum gases have been transported under pressure in spherical tanks for many years, the early liquid natural gas vessel tanks were constructed as double walled prismatic tanks, that is, tanks having primary and secondary barriers. The forces created in the walls of the tanks were transmitted to the hull structure through the insulation, which had to be of a type capable of carrying a load at low temperatures.

The above described tank systems with the exception of the suspended spheres, require considerable manpower to install. Also testing of the installation in its ability to absorb and transmit stresses from the tank to the hull of the vessel, is difficult. Self supporting independent tanks overcome the testing problem and their insulation is much simpler. Although spherical tanks have been used as an effective type of self supporting independent tank, and a number of methods for supporting them in the hull of the vessel have been proposed, the sphere is an inefficient user of space in a vessel.

Accordingly, an object of the present invention is to provide a self supporting, independent liquid or compressed gas containment tank which has a unique shape which contributes to the overall strength of the tank.

Another object of the present invention is to provide an improved self supporting storage tank which, because of its geometric shape lends itself to the accurate determination of stresses to which the tank will be subjected and thus, can be readily adapted to meet the various classification and regulatory body requirements of a single walled containment system for either land storage or the marine transportation of refrigerated liquid natural gas.

A further object of the present invention is to provide an improved storage tank which, because of its geometric shape, is capable of storing the same quantity of liquid and/or gas as the prior art spherical tanks even though it possesses smaller overall dimensions.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, the above-mentioned disadvantages may be eliminated and a substantially improved self supporting storage tank adaptable for land storage and vessel storage in connection with marine transportation has been developed wherein through the use of a plurality of cylindrical and spherical shapes which are combined in an effective manner, a tank of improved strength and capacity is produced. The storage tank of the present invention is a self-supporting, independent liquid or compressed gas containment tank, the boundaries of which are made up of intersecting cylinders, parts of spheres and cylindrical caps.

The present invention is based on the knowledge that both the sphere and the cylinder are efficient forms for pressure vessels. However, as the volume of the tank increases, it becomes expensive and eventually impractical to construct the tanks as individual spheres or cylinders due to the required thickness of the shell. The present invention overcomes this problem by combining cylinders and spheres into a unique relationship and using the resulting shape as the boundaries for the tank. Because the tank is constructed solely from intersecting portions of cylinders and spheres, the stresses can be readily determined using the available structural analysis theory for thin shells. In order to obtain a better volumetric efficiency, that is, by dividing the tank volume by the volume of the circumscribing cube, the space inside the external boundaries of the tank but outside the cylinders is made part of the tank volume by fitting six cylindrical closing caps in the square holes in the six sides of the tank and removing a 90° arc length of the cylinder within the boundaries of the tank. This deletion of a part of the cylinders would normally result in unbalanced loads in the individual cylinders. However, the manner in which the cylinders and the cylindrical closing caps are connected together enables these loads to be balanced and provides a stable structure. Due to the shape of the tank, being made up of rotationally symmetric plates, the design can be fully analyzed by various structural analysis methods such as limit analysis, finite element analysis and fracture mechanics, thus enabling the containment system to be classed as a "leak before catastrophic failure" type system. As it is a single walled vessel of relatively simple structural design, including the support system, the completed tank can be tested by non-destructive methods including hydrostatic or compressed air pressure tests. This in turn enables the tank to be readily accepted by the various regulatory agencies.

The storage tank of the present invention possesses inherent strength and good volumetric efficiency because of its unique shape. The weight of the tank and its contents is advantageously distributed to four corner pedestals disposed at the bottom of the tank. The tank can be restrained from lateral movement either at the corner pedestal plates or at a higher location on the tank depending on the intended use of the tank. Because the tanks are basically a combination of cylindrical and spherical shapes, they function as effective pressure vessels which can be provided with internal stiffeners or merely utilized as unstiffened shells. Also, because of their improved strength and volume efficiency, if the tanks of the present invention are used in a liquid natural gas tanker in place of the presently utilized spherical tanks, the length, width and depth of the tanker can be reduced by approximately 8%, 10% and 15%, respectively. With size reductions in mind, it is readily apparent that the expense of construction of the smaller size tankers can be reduced by about 10–20%. Also, there is the additional savings in the construction of the smaller size tanks. For example, using the tanks of the present invention in a 125,000 cubic meter liquid natural gas tanker, the length, width, and depth of said tanker can be reduced by 75 feet, 15 feet and 15 feet, respectively when compared with an equivalent spherical tank vessel. Thus, by utilizing the tanks of the present invention, the ship portion of the total cost can be reduced by up to about 20% and the cost of the containment tanks can be reduced also by a significant amount. Of particular importance is the fact that no machining of large parts is required and because the diameter of the cylinder is smaller than about one-half of the overall dimensions of the tank, the tank structure is thinner than spherical tanks of equal volume. This feature, of course, reduces material, welding, handling and shaping problems. The tank lends itself to construction by existing structural fabricators without the need for special machines. The tank can also be installed in a ship either in pieces or as a complete tank.

The tank can be designed for use as a fixed land liquid or compressed gas storage tank and in addition, the unique shape of said tank comprising parts of cylinders and spheres makes it suitable for a number of uses where the vessel is subjected to either internal or external pressures.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 2 is a section through a cylinder showing the various stresses created due to an internal pressure;

FIG. 3 is a schematic representation showing the effect on the stability of a cylindrical structure when an arc of the cylinder is removed and the remaining portion is still subjected to an internal pressure;

FIG. 4 is a plan view of a section taken through the tank of the present invention showing how the partial cylinders are connected together by cylindrical closing caps;

FIG. 5 is a side elevational view of the tank of the present invention;

FIG. 6 is a plan view of the tank of the present invention;

FIG. 8 is a sectional view taken along lines 8—8 of FIG. 5 showing the details of the lower corner supports for the tank;

FIG. 9 is a sectional view taken along lines 9—9 of FIG. 8 also showing details of the lower corner supports;

FIG. 9A shows a perspective view of the corner support;

FIG. 15 shows the supporting device attached to the storage tank;

FIG. 16 shows the supporting device attached to the vessel, said supporting device being adapted to compliment the supporting device attached to the tank;

FIG. 17 shows the cooperation of the respective vessel and tank supporting devices shown in FIGS. 15 and 16, respectively;

DESCRIPTION OF THE PREFERRED EMBODIMENTS

Figure 1:
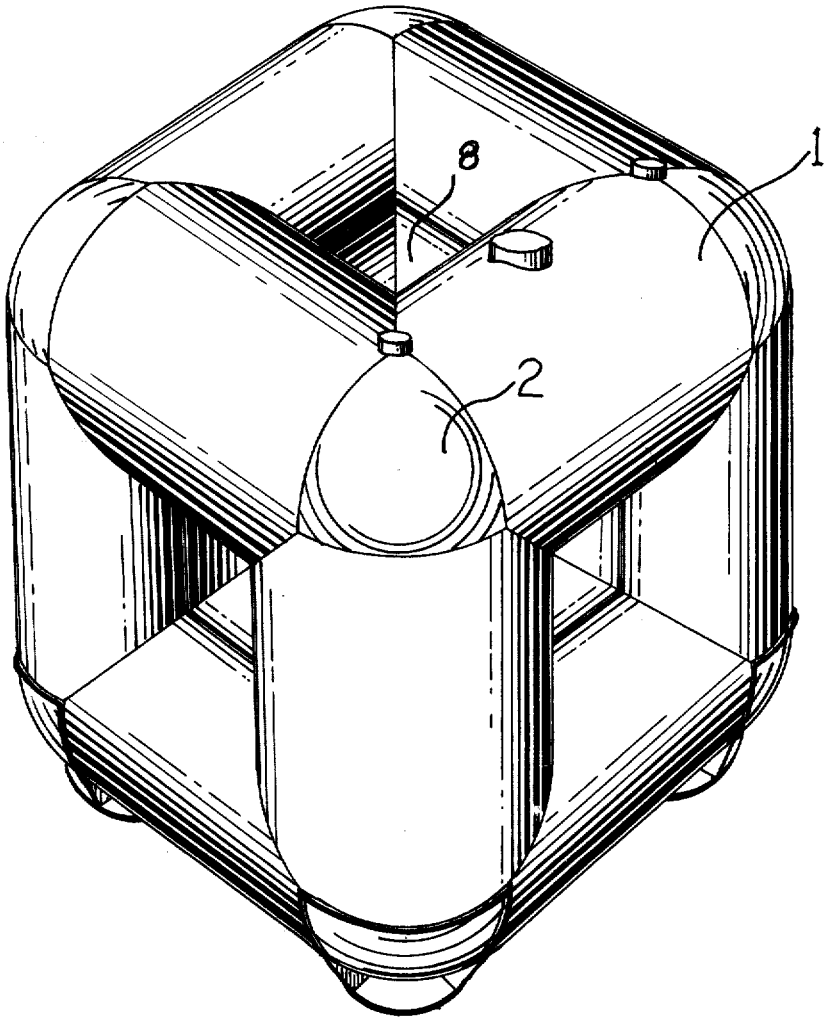
FIG. 1 is a perspective view of the storage tanks of the present invention.

Referring now to the drawings, wherein identical reference numerals are used throughout the various views to indicate identical elements, the tank of the present invention according to FIG. 1 comprises a plurality of intersecting cylindrical shell portions 1 which cooperate with portions of spheres (closing caps) 2 and portions of cylinders 8 to produce a supply tank having a generally cubical shape. As shown in FIG. 1, each corner of the tank consists of three intersecting cylinders which are disposed at an angle of 90°with respect to each other and provided with a spherical closing cap 2. The tank has eight right-angled corners and thus comprises 12 intersecting cylindrical portions, eight spherically shaped closing caps and six cylindrically shaped closing caps.

The cylindrical shell portions formed from cylindrical shells are of equal diameter and length with four of the shell portions forming a side of the tank. The shell portions are formed by removing an arc length section of the circumference of each of the shells and also by removing that portion of the ends of each of the shell portions defined by diagonally intersecting planes produced at both ends of the shell portions resulting from the intersection of three shell portions placed perpendicular to each other at each corner to form the generally cubically shaped vessel. Each aperture formed by three shell portions intersecting at each corner is closed by a spherically shaped cap. Each cap is that portion of the surface of a sphere of equal diameter to that of the cylindrical shell portions so that a continuous tank surface is found when the caps are placed in the apertures. The four cylindrical shell portions making up each side of the cubical tank also define an aperture in the middle of each of the sides. These apertures are closed by the cylindrical closing caps. These caps are formed by four identical parts of a cylindrical surface connected together to form a cylindrically shaped cap. The base of each of the cylindrical caps forms a continuous surface tangent with each of the apertures defined by the shell portions and extend inwardly into the tank.

FIG. 2 diagramatically shows how a cylinder 3 which is subjected to a uniform internal pressure will be stressed in the circumferential direction.

FIG. 3 diagramatically shows how the cylinder 3 would deform 4 if a portion of the cylinder 5 was removed but the remaining portions thereof were still subjected to a uniform internal pressure. In order to maintain the remaining portion of the cylinder 3 in an equilibrium condition, forces 6 and 7 would have to be applied to the edges either tangentially, or normal to the cylinder, respectively. A continuation of the forces in both directions would also be acceptable.

Figure 4A:
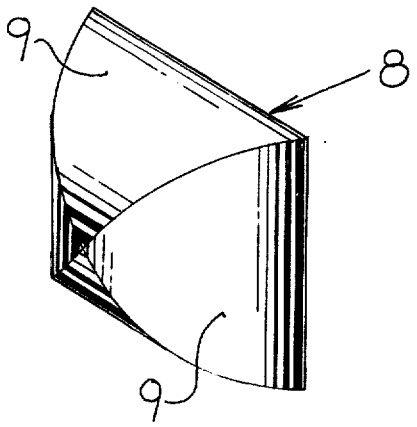
FIG. 4A shows in detail the cylindrical closing caps utilized in FIG. 4.

FIG. 4 shows how the independent cylinders 1 are connected by closing caps 8 which are constructed from four substantially equivalent portions of a cylinder 9 which cooperates in a manner shown in FIG. 4A. The type of deformation due to internal pressure a tank cross-section would be subjected to in the area of the closing caps, is indicated in FIG. 4 by numeral 10.

FIG. 5 is an external elevational view of the tank of the present invention showing four cylindrical portions 1, four spherical caps 2, one internal cylindrical closing cap 8, support pedestal webs 11 and support plate 12 which transmit the total load due to the weight of the tank and its contents to the supporting structure. Openings are provided in the top of the tank, when required, for pump installation 12 and for access aperture 13 which provides access to the tank.

FIG. 6 is an external plan view of the tank of the present invention showing the four intersecting cylinders 1, four spherical closing caps 2, one internal cylindrical closing cap 8, two pump installations 12 and one tank access aperture 13.

Figure 7:
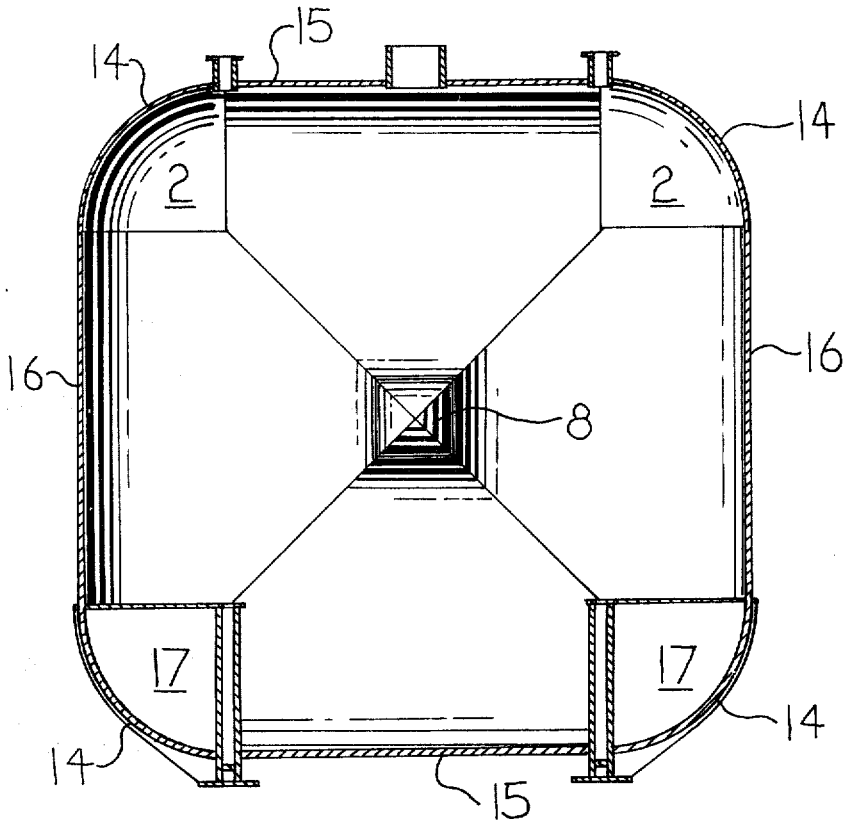
FIG. 7 is a sectional view taken along the lines 7—7 of FIG. 5.

FIG. 7 is a sectional view taken along lines 7—7 of FIG. 5 and shows, in section, four horizontal cylindrical portions 14, two horizontal cylindrical portions 15 in elevation, two vertical cylindrical portions 16,. two spherical closing caps 2 and one internal closing cap 8. It can be seen from the above described drawings and the above description that the boundary of the tank of the present invention comprises three distinct shapes formed from rotationally symmetrically plates which are joined together in a continuous manner, with the exception of where the support pedestals 11, the pump openings 12 and the access opening 13 pass through the shell, enabling the stress that the structure is subjected to, that is, the support loads, the internal pressure and the thermal loadings, to be accurately determined. This advantageous feature satisfies the requirements of various governmental regulatory bodies for acceptance of the tank of the present invention as a single walled pressure vessel for marine application without the need for a liquid-tight secondary barrier.

The unique shape of the tank of the present invention gives it considerable inherent combined strength. It is not necessary to support any portion of the tank by external or internal structure other than that already described hereinabove. However, the weight of the tank and its contents must be transferred to the supporting medium. This can be accomplished by simply allowing the bottom of the tank to bear directly on the support medium. In a preferred embodiment of the present invention, where the tank will be insulated by a non-load bearing type of insulation on the external surface of the tank, support pedestals 11 are utilized at each corner of the tank. FIG. 8 shows a plan sectional view of a support pedestal taken along lines 8—8 of FIG. 5. The upper free edges of the corner web plate 17, the internal web plate 18 and the pedestal cylinder 19 are stiffened by a horizontal web and face plate 20. The pedestal web plates and cylinder are connected to the load distribution plate 12' which transmits the load of the tank and its contents to the supporting structure. A closing plate 21, shown in FIG. 9 is fitted inside the hollow pedestal cylinder 19 at the level of the tank bottom. If considered beneficial, the closing plate 21 can be located below the level of the tank bottom thus providing a drain well for pumps, thus enabling the complete stripping of the tank. Thus, the hollow pedestal cylinder 19 is adapted to receive a deep well or submersible pump for removing the contents of the tank. Drain holes 22 are provided in the hollow pedestal cylinders at the lowest part of the tank for continuously draining the contents from the tank into said hollow pedestal cylinders. As stated above, the closing plate 21 may be slightly lower than the bottom of the tank to form a drain well for completely removing the contents from the tank. An aperture 23 is provided in the support plate 12' to provide access to the space below the closing plate 21 and to facilitate fabrication and the insulation of the space defined by the closing plate 21 and the support plate 12'. The pump installation 12 extends from the top of the tank into the hollow pedestal cylinders 19.

FIG. 9A is a perspective view of the support pedestals shown in FIGS. 8 and 9.

Figure 10:
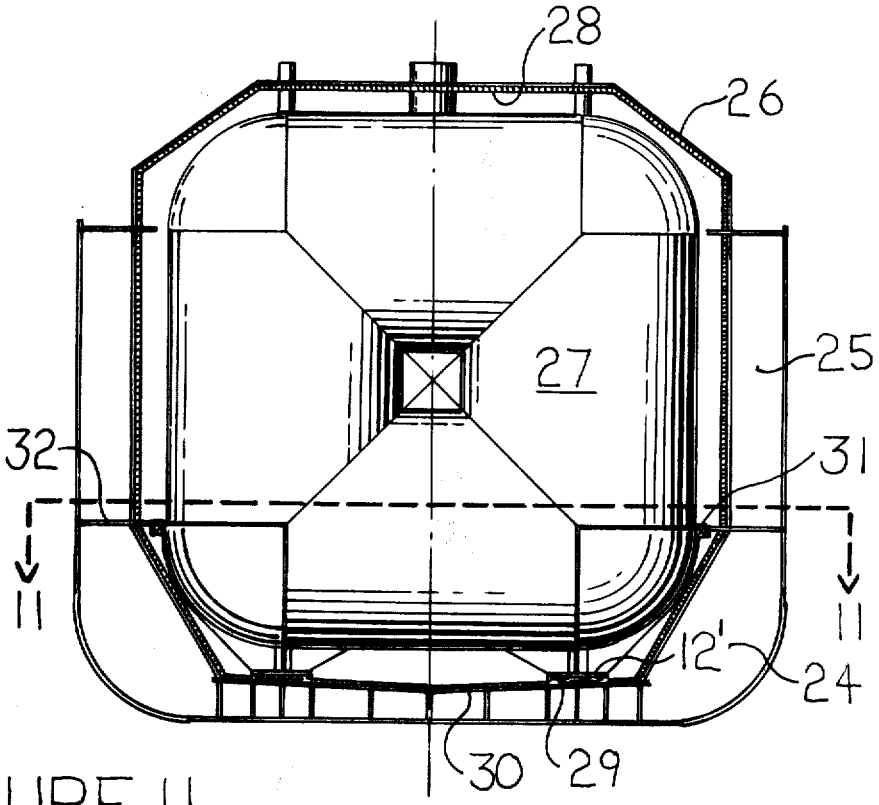
FIG. 10 is a view showing how the tank would be installed in a vessel for transporting a material.

FIG. 10 is a cross-section through a ship designed to use the tank of the present invention for transporting liquid natural gas. FIG. 10 shows a hull structure made up of a double bottom which defines bottom wing tanks 24 with sloping inner bulk heads to provide a drain well to collect any liquid in the event of leakage, side wing tanks 25 and a weather shield 26. The actual containment tank 27 advantageously would be insulated on the outside and insulation 28 covered with a sheething such as fiberglass or plywood sheets can be installed on the inner surface of the vessel and the weather shield to protect the structure from the direct effect of leakage. The weight of the tank and its contents are supported by the pedestal plates 12' which are in turn supported by hardwood 29 fitted on top of the tank top 30. The lateral support and vertical restrainment of the tank is provided by sloped bearing surface arrangements 31 disposed on the tank and on the ship's structure as can be better seen in FIGS. 12 to 14 of the present application. The tanks fits into a horizontal stringer 32, which is at the same height as the pedestal horizontal corner webs 33 but with sufficient clearance for the installation of the tank.

Figure 11:
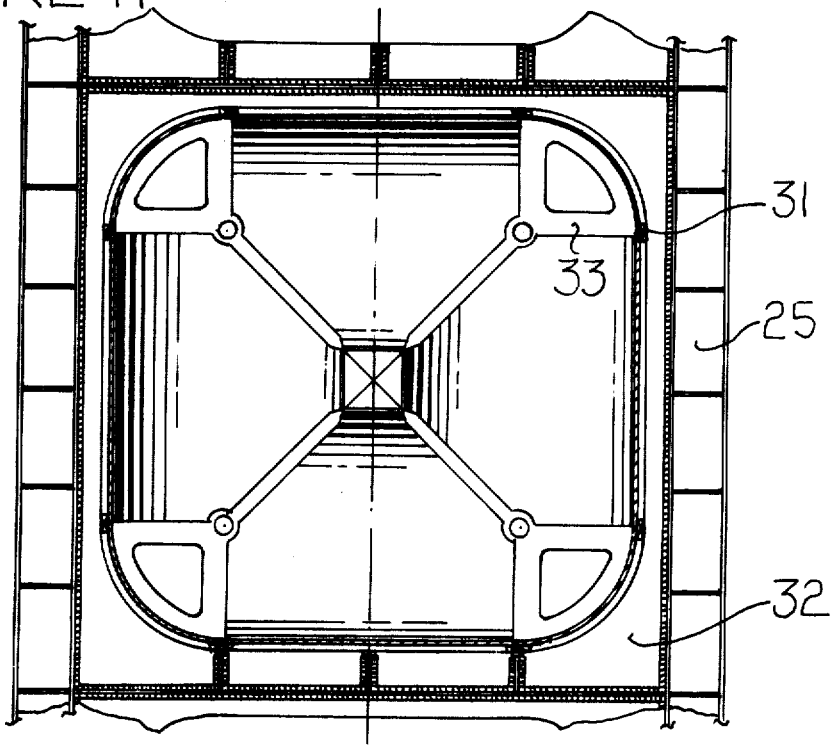
FIG. 11 is a plan view taken along lines 11—11 of FIG. 10.

FIG. 11 is a plan view taken along lines 11—11 of FIG. 10, showing in detail, how the supporting pedestals cooperate with each other and with the tank structure.

Figure 12:
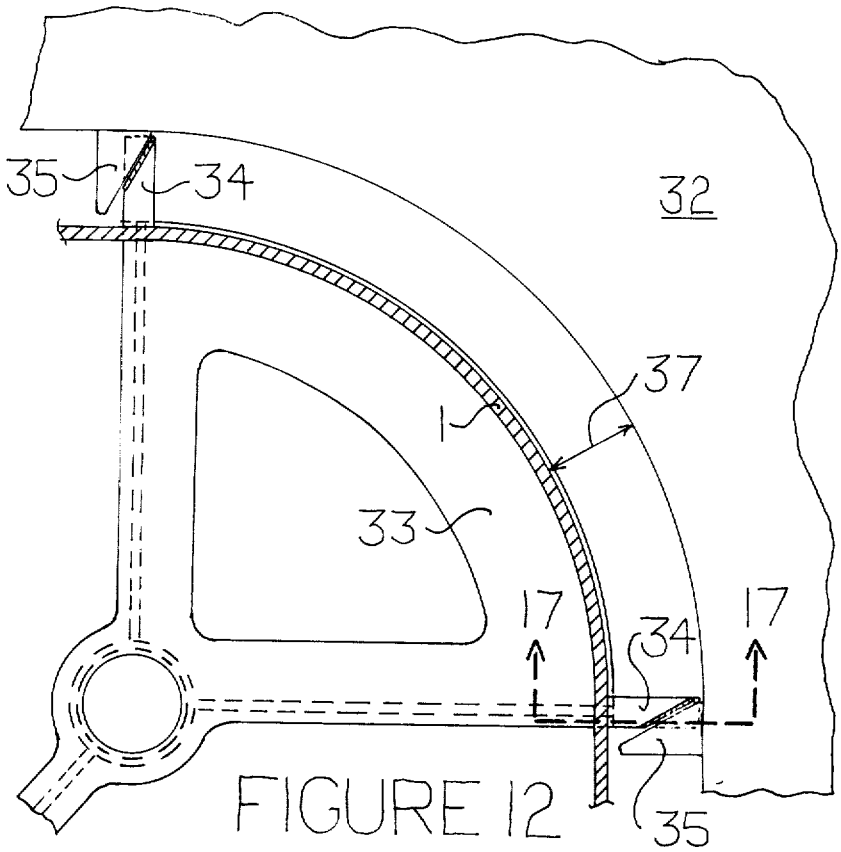
FIG. 12 is a view showing the lateral supporting device as utilized on the tank and on the surrounding ship structure.

FIG. 12 shows the details of the lateral and vertical support retainers including part of the horizontal stringer, part of the tank wall 1 and part of the pedestal horizontal corner web 33. At each support location 31 are provided two bearing pads, that is, a support element 34 attached to the tank and a cooperating supporting element 35 attached to the vessel. These supporting pads have a common slope based on the relationship between the contraction of the tank and the surrounding structure during cooling and containment of the refrigerated liquid natural gas. This insures that adequate lateral support will be provided for the tank in all of its possible states. An insulator such as hardwood 36, as best seen in FIG. 15, is provided between the two bearing or support pads 34 and 35. As stated above, the tank fits into the horizontal stringer 32 with sufficient clearance 37 for the installation of the tank.

Figure 13:
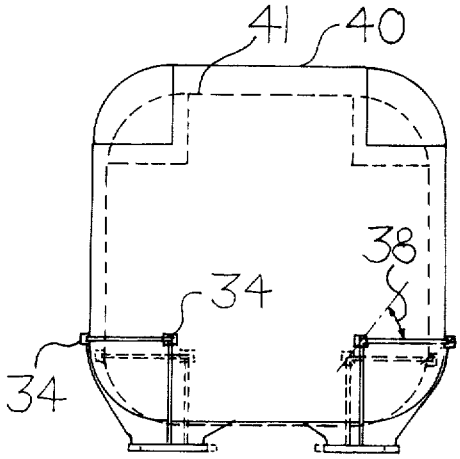
FIG. 13 shows the lateral supporting devices indicating their operation during contraction of the tank and the surrounding ship structure during cooling or filling of the tank.
Figure 14:
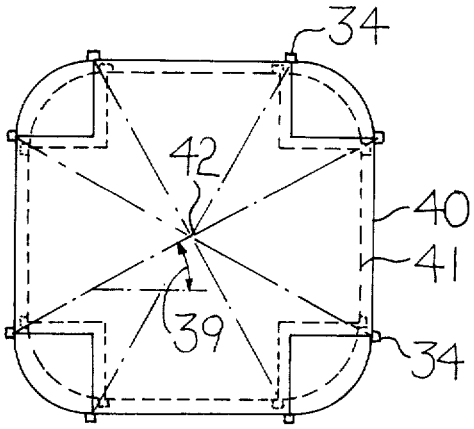
FIG. 14 shows a plan view of FIG. 13.

FIGS. 13 and 14 show how the slopes of the pads in both the vertical direction 38 and the horizontal direction 39 are determined. These Figures indicate, diagramatically, how the tank contracts due to the storage of low temperature liquids in said tank. If the surrounding ship's structure is of the same material as that of the tank and is subjected to the same uniform temperature differential, then there would be no relative movement of support points on the tank and ship's structure and accordingly, the tank could be mechanically secured to the ship's structure. However, because the tank is insulated to reduce heat inflow to a practical minimum and, because, in some instances, the ship's structure is also insulated to prevent it from being subjected to low temperatures, the movement of the support points on the tank and on the ship's structure is not the same. The present invention accommodates this relative movement between the tank and the ship's structure in both the vertical and the horizontal directions by aligning the slopes of the bearing surfaces in the vertical and horizontal directions in the direction of contraction. Thus, to account for the relative movement between the tank and the ship's structure due to different temperature differentials and construction materials, the length of the bearing surface of the support pads 35 on the ship's structure is made longer then that of support pad 34 which is connected to the tank, in accordance with the ratio of the relative movement of the tank with respect to the ship. The slopes of the vertical bearing surfaces 38 and the horizontal bearing surfaces 39 are determined as shown in FIGS. 13 and 14. The tank, in contracting from its size 40 at ambient temperature to its size 41 at a much lower temperature, the tank support pad 34 moves in toward the center of the tank and down toward the bottom pedestals. Knowing the temperature differential and the properties of the tank material, the slopes can be determined either by calculation and/or graphically. It should be noted that in the vertical direction, the bottom of the load distribution plate 12 is the fixed reference point for the contraction whereas in the horizontal direction the fixed reference point is the vertical center line of the tank 42 because said reference point does not move.

FIGS. 15 and 16 are exploded isometric views of the support pads, FIG. 15 also showing the hardwood insulator 36 on both bearing surfaces of support pad 34. FIG. 17 shows a sectional elevational view of the cooperation of the support pads 34 and 35 taken along lines 17—17 of FIG. 12. The lateral support arrangement lends itself to a relatively simple installation in that the support pad 35 which is attached to the ship's structure can be installed once the tank is in its final position in the ship, by simply fitting it into contact with support pad 44 already attached to the tank, and welding support pad 35 to the ship's structure. Accordingly, no machining or measuring is necessary on the ship.

Figure 18:
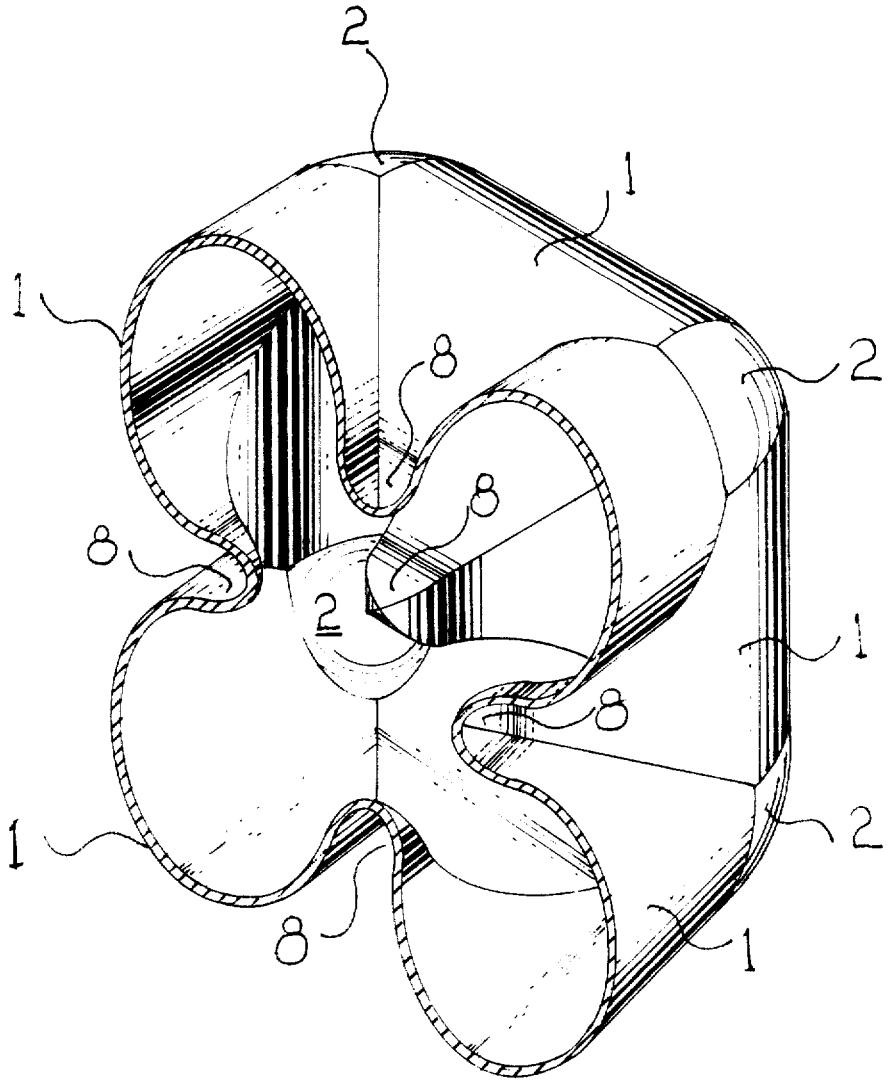
FIG. 18 shows a perspective view of the tank of FIG. 1, cut in half by a vertical plane.

FIG. 18, which shows the tank of FIG. 1 with one-half of said tank removed, indicates how the internal closing caps 8 are arranged with respect to the cylindrical shells.

The present invention being thus described, it will be obvious that the same may be varied in many ways. Such variations are not be to be regarded as a departure from the spirit and scope of the invention, and all such modifications are intended to be included within the scope of the following claims.

I claim:

1. A cubical-shaped storage tank comprising 12 equal diameter and equal length portions of cylindrical shells, three of said shells forming each corner of said tank and four of said shells forming each side of said tank, said portions of the cylindrical shells being formed by removing an arc length section of the circumference of each of the cylindrical shells and also by removing that portion of the ends of each of the cylindrical shells defined by diagonally intersecting planes produced at both ends of the cylindrical shell portions resulting from the intersection of said three cylindrical shell portions placed perpendicular to each other at each corner forming a generally cubically shaped outer boundary, said intersecting cylindrical shell portions at each corner forming an aperture closed by spherically shaped caps forming a continuous tank surface, said spherically shaped caps consisting of that portion of the surface of a sphere of equal diameter to that of the cylindrical shells, and said four cylindrical shell portions which make up each side of the cubical shape defining an aperture in the middle of each of said sides, said aperture being closed by four identical parts of a cylindrical surface connected together forming a closed cap, the base of said cap forming a continuous surface tangent with the aperture defined by said cylindrical shell portions and extending inwardly into said tank.

2. The storage tank of claim 1, wherein a 90° arc length section is removed from the circumference of each of the cylindrical shells to form said portions of said cylindrical shells.

3. The storage tank of claim 1, comprising 12 intersecting portions of cylindrical shells, eight of which are horizontally disposed and four being vertically disposed, eight spherically shaped corner caps provided at each of the corners of said storage tank and six closing cylindrical caps provided at the center of each side of said storage tanks, said intersecting portions of cylindrical shells, spherically shaped corner caps and closing cylindrical caps combining and cooperating to form a continuous tank surface with a generally cubical shape.

4. The supply tank of claim 1, wherein four corners of said tank are provided with a pedestal support structure.

5. The supply tank of claim 4, wherein at least one of the pedestal support structure is provided with a hollow pedestal cylinder which communicates with the inside of the tank at about the level of the tank bottom.

6. The supply tank of claim 5, including a submersible pump which is disposed in the hollow pedestal cylinder for stripping the tank of its contents.

7. The supply tank of claim 5, wherein a closing plate is disposed in the hollow pedestal cylinder at a level below the bottom of the tank to form a drain well in the hollow pedestal cylinder.

8. The supply tank of claim 4, wherein each of the pedestal support structures comprises a substantially vertically disposed pedestal cylinder provided with a horizontally disposed corner face plate spaced apart from a horizontally disposed, load distribution plate, said face plate tying the spherically shaped caps to the portions of cylindrical shells and extending to the center portion of the tank.

9. The supply tank of claim 8, wherein corner web plates and an internal web plate extend vertically from the load distribution plate to the face plate, said internal web plate extending to the center portion of the tank.

10. The supply tank of claim 1, wherein access openings are provided in the shell of the tank.

11. The supply tank of claim 1, disposed in a marine vessel.

12. The supply tank of claim 11, wherein the vessel and said supply tank are each provided with lateral support bearing pads, said bearing pads having bearing surfaces which are in slidable engagement with each other to provide support when there is relative movement in three planes between the tank and the vessel.

13. The supply tank of claim 12, wherein said relative movement includes the vertical, transverse and longitudinal directions.

14. The supply tank of claim 12, wherein said bearing pads contain sloped surfaces which are designed to maintain surface contact between engaging bearing pads during vertical, transverse and longitudinal relative movement between the tank and the vessel.

15. The supply tank of claim 12, wherein the bearing surface of the pads prevents vertical movement due to the vessels motion at sea.

16. The supply tank of claim 12, wherein the support bearing pads for the tank are positioned in association with the pedestal support structure.

* * * * *